US011779994B2

(12) United States Patent
Se et al.

(10) Patent No.: US 11,779,994 B2
(45) Date of Patent: Oct. 10, 2023

(54) HEAT EXCHANGER AND MANUFACTURING METHOD THEREFOR

(71) Applicant: NORITZ CORPORATION, Hyogo (JP)

(72) Inventors: Naoki Se, Kobe (JP); Hideyuki Fujisawa, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/845,556

(22) Filed: Jun. 21, 2022

(65) Prior Publication Data

US 2022/0410247 A1 Dec. 29, 2022

(30) Foreign Application Priority Data

Jun. 23, 2021 (JP) ..... 2021-104380

(51) Int. Cl.

| | |
|---|---|
| ***F28F 9/26*** | (2006.01) |
| ***B21D 53/08*** | (2006.01) |
| ***B21D 39/08*** | (2006.01) |
| ***F28D 1/02*** | (2006.01) |
| ***F28D 1/047*** | (2006.01) |

(Continued)

(52) U.S. Cl.

CPC ..... *B21D 53/085* (2013.01); *B21D 39/08* (2013.01); *F28D 1/0213* (2013.01); *F28D 1/0477* (2013.01); *F28F 9/182* (2013.01); *F28F 9/26* (2013.01); *F24H 1/41* (2013.01); *F28F 2275/04* (2013.01)

(58) Field of Classification Search

CPC .... F16L 13/08; F28F 9/26; F28F 9/182; F28F 2275/04; F28F 2275/045; F28D 1/0477; F24H 1/41

See application file for complete search history.

(56) References Cited

U.S. PATENT DOCUMENTS 5,713,611 A * 2/1998 Kurimoto ..... B21D 39/06 29/523
2011/0215573 A1* 9/2011 Tanaka ..... F01N 13/08 29/523

(Continued)

FOREIGN PATENT DOCUMENTS

FR 1133503 A * 3/1957
JP S52-149658 A 12/1977

(Continued)

*Primary Examiner* — Eric S Ruppert
(74) *Attorney, Agent, or Firm* — Studebaker & Brackett PC

(57) ABSTRACT

A heat exchanger includes a plurality of heat transfer tubes housed in a predetermined case, a connecting tube body for connecting the plurality of heat transfer tubes, a predetermined tube expansion portion provided on each heat transfer tube, a first peripheral wall portion provided on the tube expansion portion, and a second peripheral wall portion that is positioned on an end portion of the connecting tube body and fitted to the tube expansion portion, wherein the first and second peripheral wall portions have different sectional shapes and are fitted together in a partial contact state including predetermined contact and non-contact portions. According to this configuration, the heat transfer tubes can be fixed to a side wall portion of the case and the connecting tube body can be connected to the heat transfer tubes easily and appropriately.

6 Claims, 9 Drawing Sheets

(51) Int. Cl.
*F28F 9/18* (2006.01)
*F24H 1/41* (2022.01)

(56) References Cited

U.S. PATENT DOCUMENTS

| | | | | |
|---|---|---|---|---|
| 2019/0128331 | A1* | 5/2019 | Zahradnik | F16D 1/068 |
| 2020/0103142 | A1* | 4/2020 | Se | F24H 1/40 |
| 2020/0103182 | A1* | 4/2020 | Hokada | B21D 53/08 |

FOREIGN PATENT DOCUMENTS

| | | | |
|---|---|---|---|
| JP | S63-259395 | A | 10/1988 |
| JP | 2020-51682 | A | 4/2020 |

* cited by examiner

HEAT EXCHANGER AND MANUFACTURING METHOD THEREFOR

BACKGROUND OF THE INVENTION

Field of the Invention

The present invention relates to a heat exchanger used in a water heating application or the like in a water heater, for example, and a manufacturing method therefor.

Description of the Related Art

The present applicant has previously proposed the invention described in Japanese Patent Application Publication No. 2020-51682 as an example of a heat exchanger.

The heat exchanger described in this document is incorporated into a water heater or the like and used to heat water, and a plurality of heat transfer tubes are housed in a case to which a heating medium is supplied. End portions of the plurality of heat transfer tubes are drawn out to an exterior of the case by being passed through hole portions provided in a side wall portion of the case, and respective end portions of substantially semicircular arc-shaped connecting tube bodies are fitted to these parts. Thus, the plurality of heat transfer tubes are connected in series via the connecting tube bodies such that water can flow appropriately from one end side to the other end side thereof and water can be heated during the flowing process.

Further, a tube expansion portion is provided on the heat transfer tube as fixing means for fixing the heat transfer tube to the side wall portion of the case, and the tube expansion portion is brazed to the side wall portion. The tube expansion portion is configured to include both a press-fitted portion in which the outer peripheral surface of the heat transfer tube is press-fitted to an inner peripheral surface of the hole portion in the side wall portion, and a flared portion that has a flared shape and is positioned further toward an end portion tip end side of the heat transfer tube than the press-fitted portion.

When, in contrast to this configuration, tube expansion processing is implemented only to provide the press-fitted portion on the heat transfer tube, the aperture of the heat transfer tube on the end portion tip end side tends to shrink, and as a result, there is a danger that it will be difficult to connect the connecting tube body. According to the above configuration, on the other hand, the end portion of the connecting tube body can easily be fitted to the flared portion, and therefore this danger can be eliminated.

As described below, however, there remains room for improvement in the prior art described above.

When the flared portion having a flared shape is formed on the end portion tip end side of the heat transfer tube, although it becomes easier to fit the end portion of the connecting tube body into this part, the heat transfer tube and the connecting tube body cannot be fitted together in a contacting state in the location where the flared portion is formed. It is therefore difficult to realize a provisionally held state in which the connecting tube body is held with stability simply by fitting the end portion of the connecting tube body into the end portion of the heat transfer tube. As a result, when the case of the heat exchanger, in a state where the connecting tube bodies are fitted to the heat transfer tubes, is transported to a brazing operation position for brazing the connecting tube bodies to the heat transfer tubes during a manufacturing process of the heat exchanger, there is a danger that the connecting tube bodies will fall off the heat transfer tubes or the like. In order to improve the efficiency and appropriateness of the operation for manufacturing the heat exchanger, it is desirable to eliminate this danger as appropriate.

As means for eliminating this danger, the flared portion may be omitted. However, when the flared portion is simply omitted, it becomes difficult to appropriately control the fitting state between the heat transfer tube and the connecting tube body. When a fitting tolerance between the heat transfer tube and the connecting tube body is inappropriate such that interference between the heat transfer tube and the connecting tube body is large, it becomes difficult to fit and connect the connecting tube body to the heat transfer tube. Conversely, when a gap between the heat transfer tube and the connecting tube body is large, it becomes difficult to provisionally hold the connecting tube body on the heat transfer tube with stability.

CITATION LIST

Patent Literature

[PTL 1] Japanese Patent Application Publication No. 2020-51682

[PTL 2] Japanese Patent Application Publication No. S52-149658

[PTL 3] Japanese Patent Application Publication No. S63-259395

SUMMARY OF THE INVENTION

An object of the present invention is to provide a heat exchanger and a manufacturing method therefor with which heat transfer tubes can be fixed to a side wall portion of a case and a connecting tube body can be connected to the heat transfer tubes easily and appropriately.

To solve the problems described above, the present invention teaches the following technical means.

A heat exchanger provided by a first aspect of the present invention includes a case having a side wall portion, a heating medium being supplied into an interior of the case, a plurality of heat transfer tubes that are drawn out to an outside from the interior of the case by inserting end portions thereof respectively through a plurality of hole portions provided in the side wall portion, at least one connecting tube body for connecting the plurality of heat transfer tubes to each other, a tube expansion portion provided on each of the heat transfer tubes so as to form a press-fitted portion in which an outer peripheral surface of each heat transfer tube is press-fitted to an inner peripheral surface of each of the hole portions, a first peripheral wall portion provided on the tube expansion portion in a position further toward an end portion tip end side of each of the heat transfer tubes than the press-fitted portion, and a second peripheral wall portion positioned on an end portion of the connecting tube body and fitted to the tube expansion portion, wherein the first and second peripheral wall portions have different sectional shapes and are fitted together in a partial contact state including a contact portion in which respective circumferential direction parts of the first and second peripheral wall portions contact each other and a non-contact portion in which other parts are separated from each other via a gap.

In the heat exchanger according to the present invention, preferably, a plurality of contact portions positioned at equal intervals in the circumferential direction of the first and second peripheral wall portions are provided as the contact portion, and a plurality of non-contact portions respectively positioned between the plurality of contact portions in the circumferential direction of the first and second peripheral wall portions are provided as the non-contact portion.

Preferably, the heat transfer tubes and the connecting tube bodies are both formed using round pipes, the hole portions in the side wall portion are circular, the press-fitted portion and the second peripheral wall portion have a hollow, circular sectional shape, and the first peripheral wall portion has a hollow, non-circular sectional shape.

Preferably, the second peripheral wall portion is fitted into the first peripheral wall portion, and an inner peripheral surface of the first peripheral wall portion includes a plurality of first curved surface portions that have a larger curvature radius than an outer peripheral surface of the second peripheral wall portion and are provided at intervals in the circumferential direction so as to partially contact the outer peripheral surface of the second peripheral wall portion, and a plurality of second curved surface portions that are provided so as to connect the plurality of first curved surface portions to each other without contacting the outer peripheral surface of the second peripheral wall portion.

Preferably, the tube expansion portion extends inside the case beyond the press-fitted portion, and the second peripheral wall portion is fitted into the tube expansion portion so as to advance to a position further inside the case than the press-fitted portion.

Preferably, the tube expansion portion includes first and second bulge portions in which the outer peripheral surface of each heat transfer tube partially bulges outward in a radial direction so as to sandwich the side wall portion in an axial length direction of the heat transfer tube, and which are connected to respective sides of the press-fitted portion, and the first peripheral wall portion is positioned further toward the end portion tip end side of the heat transfer tube than the press-fitted portion and the second bulge portion of the tube expansion portion.

Preferably, the second bulge portion has a hollow, circular sectional shape and the first peripheral wall portion has a hollow, non-circular sectional shape, and the tube expansion portion includes an auxiliary portion that is positioned between the second bulge portion and the first peripheral wall portion in order to create variation in the sectional shape from the second bulge portion to the first peripheral wall portion.

A manufacturing method for a heat exchanger provided by a second aspect of the present invention includes a tube expansion step in which, in a state where end portions of a plurality of heat transfer tubes are respectively inserted through a plurality of hole portions provided in a side wall portion of a case into which a heating medium is supplied, tube expansion processing is implemented on each of the heat transfer tubes, thereby forming a tube expansion portion including a press-fitted portion, in which an outer peripheral surface of each heat transfer tube is press-fitted to an inner peripheral surface of the corresponding hole portion, and a first peripheral wall portion positioned further toward an end portion tip end side of the heat transfer tube than the press-fitted portion, and a tube body connection step performed after the tube expansion step to fit respective end portions of a connecting tube body for connecting the plurality of heat transfer tubes to each other to the first peripheral wall portion of each of the heat transfer tubes, wherein, in the tube expansion step, the first peripheral wall portion is formed in a different sectional shape to a second peripheral wall portion constituting the end portion of the connecting tube body, and in the tube body connection step, the first and second peripheral wall portions are fitted together such that parts thereof in a circumferential direction contact each other and other parts thereof are separated from each other via a gap.

Preferably, the tube expansion step is performed using a divided punch having an expandable and contractable portion that can be inserted into the heat transfer tube and caused to expand and contract in a radial direction, a site for expanding the press-fitted portion and the first peripheral wall portion being provided on an outer peripheral surface of the expandable and contractable portion.

Preferably, the expandable and contractable portion of the divided punch is formed by combining a plurality of segments formed as separate members, and sites on the plurality of segments that correspond to the press-fitted portion are constituted by sites that include a plurality of first outer surface portions, the plurality of first outer surface portions having arc-shaped cross-sections with identical curvature radii and equal distances from a center of the expandable and contractable portion at the time of tube expansion, while sites on the plurality of segments that correspond to the first peripheral wall portion include a plurality of second outer surface portions, the plurality of second outer surface portions having arc-shaped cross-sections with non-identical curvature radii and unequal distances from the center of the expandable and contractable portion at the time of tube expansion.

Other features and advantages of the present invention will become more apparent from the embodiments of the invention, to be described below with reference to the attached figures.

DETAILED DESCRIPTION OF THE PREFERRED EMBODIMENTS

Preferred embodiments of the present invention will be described specifically below with reference to the figures.

Figure 1:
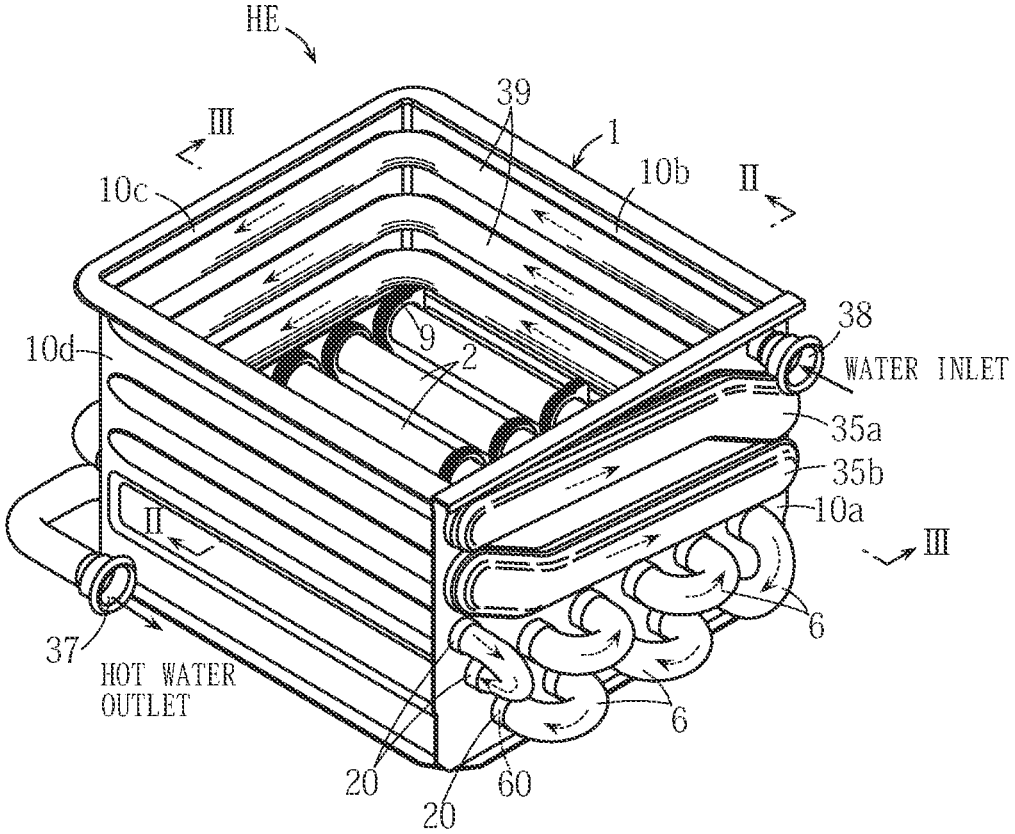
FIG. 1 is a perspective view showing an example of a heat exchanger according to the present invention.

A heat exchanger HE shown in FIG. 1 is incorporated into a water heater, for example, and used to heat water for use in a hot water supply.

The basic configuration of the heat exchanger HE is similar to that of the heat exchanger described in Japanese Patent Application Publication No. 2020-51682, and includes a substantially rectangular frame-shaped case 1 that is open at the top and bottom, a plurality of trunk pipes 39, a plurality of fins 9, a plurality of heat transfer tubes 2 housed therein, and a plurality of connecting tube bodies 6 for connecting the heat transfer tubes 2 to each other.

The heat exchanger HE is used in a reverse combustion type water heater, and a burner (not shown) is disposed in an upper portion of the case 1 so that combustion gas (an example of the heating medium) generated by the burner is supplied into the case 1. Water passing through the trunk pipes 39 and the plurality of heat transfer tubes 2 is heated by the combustion gas, whereby hot water is generated.

The plurality of trunk pipes 39 serve to absorb heat used to heat water and cool a plurality of side wall portions 10*b* to 10*d* of the case 1, and are provided to extend around respective inner surfaces of the plurality of side wall portions 10*b* to 10*d*. The plurality of trunk pipes 39 are connected via header portions 35*a*, 35*b* provided on an outer surface portion of a side wall portion 10*a* of the case 1. As shown by dotted line arrows in FIG. 1, water supplied to a water inlet 38 of the trunk pipes 39 passes through the trunk pipes 39 and the plurality of header portions 35*a*, 35*b*, then flows into the plurality of heat transfer tubes 2, and after passing through the plurality of heat transfer tubes 2 reaches a hot water outlet 37.

Figure 2:
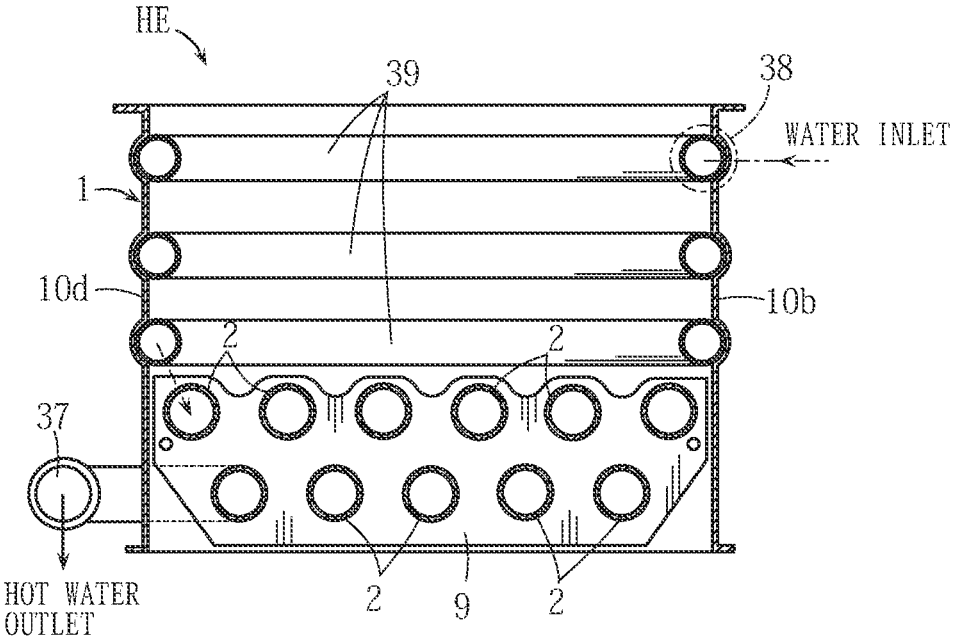
FIG. 2 is a II-II sectional view of FIG. 1.
Figure 3:
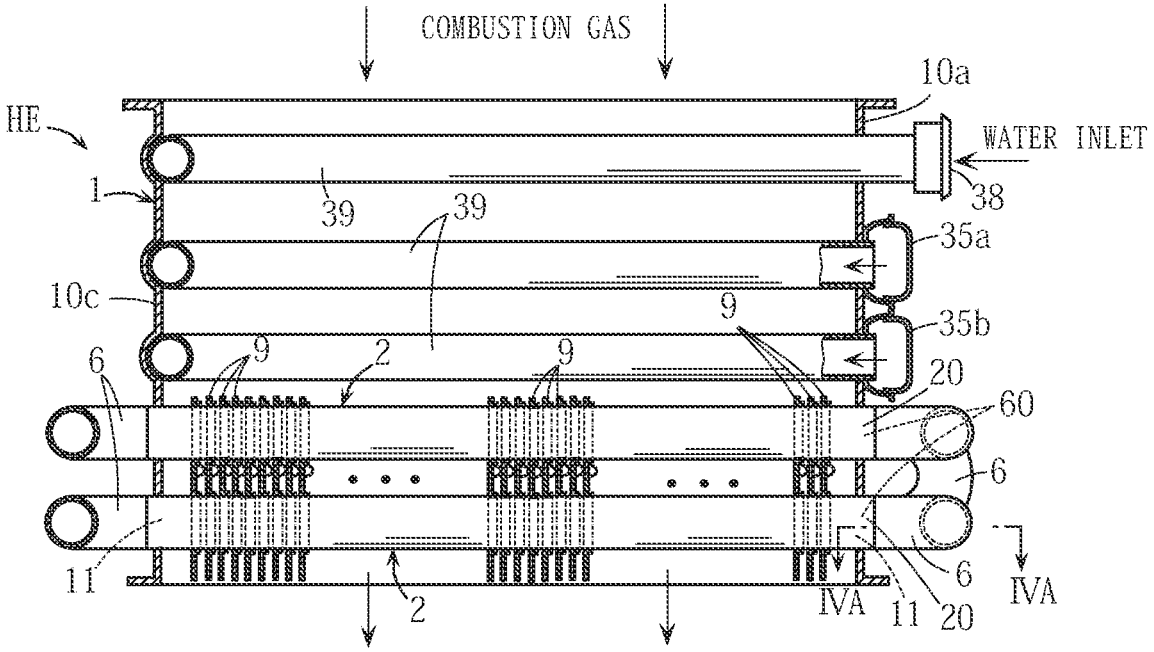
FIG. 3 is a sectional view of FIG. 1.

The plurality of heat transfer tubes 2 and the plurality of connecting tube bodies 6 are both formed using round metal (stainless steel, for example) pipes. As shown in FIGS. 2 and 3, the plurality of heat transfer tubes 2 are fin tubes that are inserted through and joined to the plurality of fins 9, and are laid horizontally inside the case 1 so as to be arranged in vertical and horizontal directions. Respective end portions of each heat transfer tube 2 are drawn out to the outside of the case 1 by being inserted through hole portions 11 provided in the side wall portions 10*a*, 10*c* of the case 1.

The plurality of connecting tube bodies 6 are bend tubes having, for example, a substantially semicircular arc-shaped overall shape when seen from the side, and respective end portions 60 thereof are joined and connected to the end portions of the plurality of heat transfer tubes 2. As a result, the plurality of heat transfer tubes 2 are connected in series via the plurality of connecting tube bodies 6.

Figure 4A:
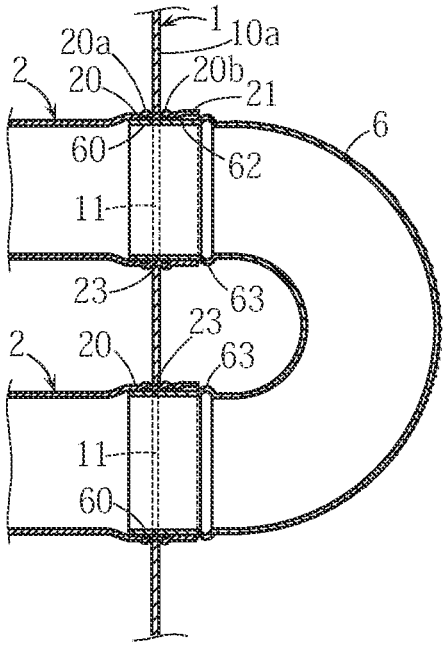
FIG. 4A is an IVA-IVA enlarged sectional view of the main parts of FIG. 3.
Figure 4B:
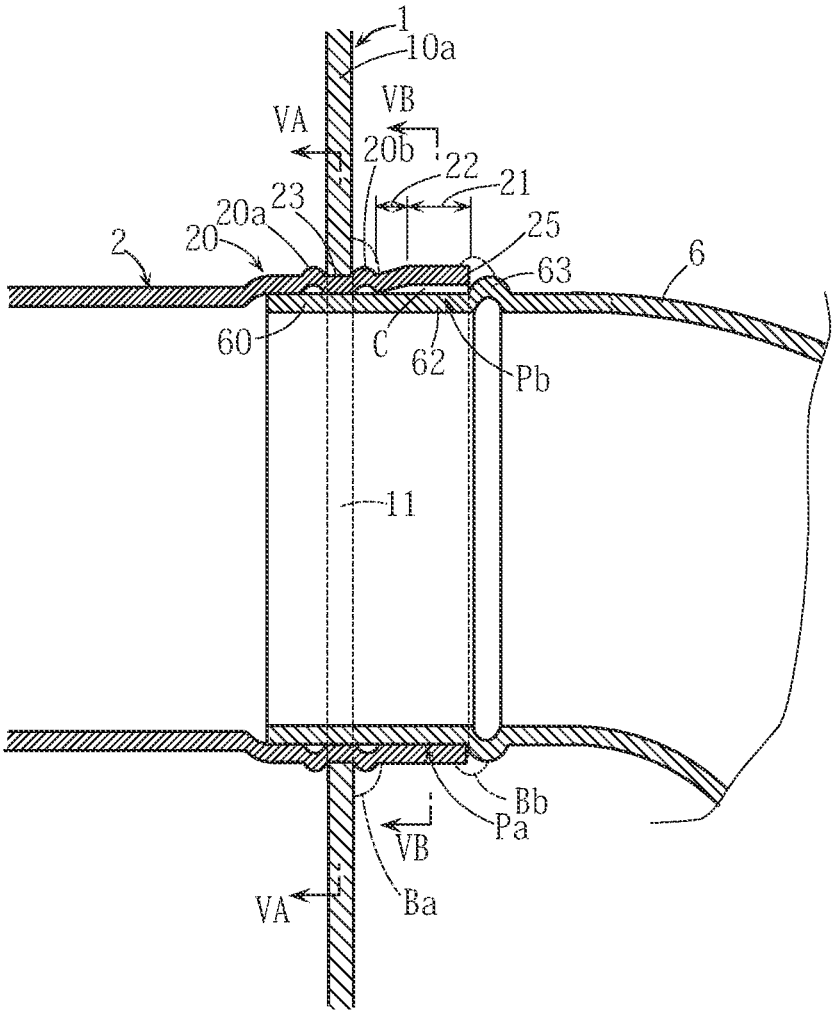
FIG. 4B is partially enlarged sectional view of FIG. 4A.

As shown in FIGS. 4A and 4B, each heat transfer tube 2 is provided with a tube expansion portion 20 in which the outer diameter and inner diameter are larger than in the other parts of the heat transfer tube 2. The tube expansion portion 20 includes a press-fitted portion 23, first and second bulge portions 20*a*, 20*b*, an auxiliary portion 22, and a first peripheral wall portion 21.

The end portion 60 of the connecting tube body 6 is fitted into the tube expansion portion 20, and the end portion 60 has a hollow, circular sectional shape. A part 62 of the end portion 60 of the connecting tube body 6 that is joined to the tube expansion portion 20 so as to be positioned inside the tube expansion portion 20 corresponds to an example of a "second peripheral wall portion" of the connecting tube body according to the present invention (and will be referred to hereafter as the second peripheral wall portion 62). Further, in this embodiment, a bulge portion 63 is formed on the connecting tube body 6. The bulge portion 63 is set to contact an end portion tip end 25 of the heat transfer tube 2.

Figure 5A:
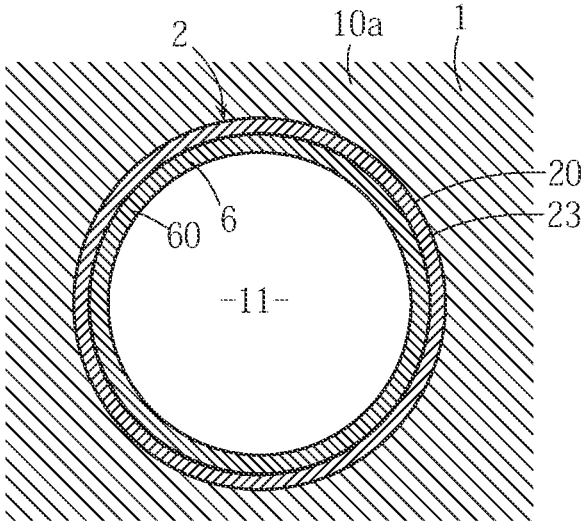
FIG. 5A is a VA-VA sectional view of FIG. 4B.

The press-fitted portion 23 of the tube expansion portion 20 is a site that is positioned in the hole portion 11 of the side wall portion 10*a* and press-fitted to an inner peripheral surface of the hole portion 11, and by providing the press-fitted portion 23, the side wall portion 10*a* and the heat transfer tube 2 are fixed (provisionally fixed) to each other. The hole portion 11 is a circular hole portion (also see FIG. 5A), and the press-fitted portion 23 has a hollow, circular sectional shape.

The first and second bulge portions 20*a*, 20*b* of the tube expansion portion 20 are annular bulge portions that are positioned respectively on an inside and an outside of the side wall portion 10*a* of the case 1 so as to sandwich the side wall portion 10*a* in an axial length direction of the heat transfer tube 2, and have outer peripheral surfaces that partially bulge outward in a radial direction of the heat transfer tube 2. The first and second bulge portions 20*a*, 20*b* are preferably disposed in contact with the side wall portion 10*a*. By providing the first and second bulge portions 20*a*, 20*b*, the heat transfer tube 2 can be fixed to the side wall portion 10*a* more reliably and firmly. A region between the first and second bulge portions 20*a*, 20*b* serves as the press-fitted portion 23 described above.

The auxiliary portion 22 is a site positioned between the second bulge portion 20*b* and the first peripheral wall portion 21. The second bulge portion 20*b*, similarly to the press-fitted portion 23, has a hollow, circular sectional shape, whereas the first peripheral wall portion 21, as will be described below, has a hollow, non-circular sectional shape. The auxiliary portion 22 is a site in which the sectional shape described above varies over a range extending from the second bulge portion 20*b* to the first peripheral wall portion 21, and is useful in facilitating processing for forming the first peripheral wall portion 21.

The first peripheral wall portion 21 is a site that is further toward the end portion tip end 25 side of the heat transfer tube 2 than the second bulge portion 20*b* and the auxiliary portion 22, and has a hollow, non-circular sectional shape. The end portion 60 (including the second peripheral wall portion 62) of the connecting tube body 6, meanwhile, has a hollow, circular sectional shape.

Figure 5B:
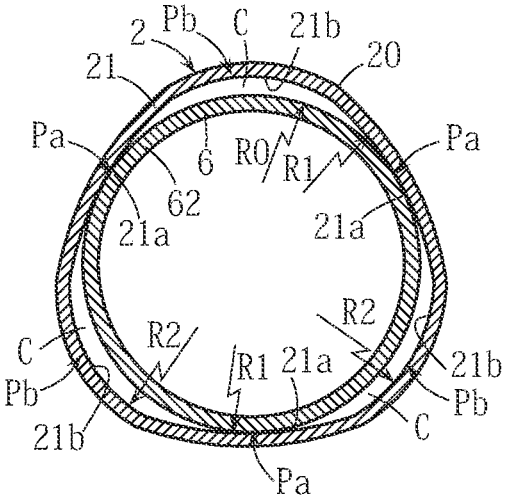
FIG. 5B is a VB-VB sectional view of FIG. 4B.

More specifically, as shown in FIG. 5B, the first peripheral wall portion 21 includes three first and three second curved surface portions 21*a*, 21*b*, for example, as the inner peripheral surface thereof. The first curved surface portions 21*a* have a curvature radius R1 that is larger than a curvature radius R0 of an outer peripheral surface of the second peripheral wall portion 62 of the connecting tube body 6 and partially contact the outer peripheral surface of the second peripheral wall portion 62 so as to form contact portions Pa. The plurality of first curved surface portions 21*a* and contact portions Pa are provided at equal angular intervals in a circumferential direction of the first and second peripheral wall portions 21, 62.

The second curved surface portions 21*b* are provided to connect the plurality of first curved surface portions 21*a* to each other without contacting the outer peripheral surface of the second peripheral wall portion 62. A gap C is formed between the second curved surface portion 21*b* and the second peripheral wall portion 62. The parts of the first and second peripheral wall portions 21, 62 that are separated from each other via the gaps C constitute non-contact portions Pb. A curvature radius R2 of the second curved surface portion 21*b* has a relationship of R2<R0<R1, for example.

The connecting tube body 6 is fitted into the heat transfer tube 2 so that the tip end of the end portion 60 thereof is positioned further inside the case 1 than the side wall portion 10*a*. In so doing, a similar effect to that obtained by adding the end portion 60 of the connecting tube body 6 to a joint location between the heat transfer tube 2 and the side wall portion 10*a* as a reinforcing member can be achieved, and as a result, the strength of the joint location between the heat transfer tube 2 and the side wall portion 10*a* is improved. This is also effective in improving the strength of a joint location between the connecting tube body 6 and the heat transfer tube 2.

In this embodiment, as shown in FIG. 4B, brazed portions Ba, Bb are provided. The brazed portion Ba is a part where the vicinity of the second bulge portion 20*b* is brazed to the side wall portion 10*a*. The brazed portion Bb is a part where the end portion tip end 25 of the heat transfer tube 2 is brazed to the outer peripheral surface of the connecting tube body 6, and the brazed portion Bb also advances into the aforementioned gaps C.

Next, an example of a manufacturing method for the heat exchanger HE will be described.

A divided punch 5 such as that shown in FIGS. 6A to 6D and 7A to 7D is used when manufacturing the heat exchanger HE. To facilitate comprehension, the divided punch 5 will be described first.

The divided punch 5 is a substantially tubular member into which a mandrel 4 is inserted. The divided punch 5 is formed by combining a plurality of segments 50*a* into a bundle and fitting a plurality of elastic O-rings 55 to the exterior thereof so as to restrain the plurality of segments 50*a* and prevent the divided punch 5 from breaking apart. The plurality of segments 50*a* correspond to a configuration in which a substantially cylindrical member is cut along an axial length direction thereof so as to be divided into six members, for example. An inclined surface 56 is provided on an inner peripheral surface of the divided punch 5 near a tip end portion thereof. Accordingly, as shown in FIGS. 7A to 7D, when the mandrel 4 is caused to advance so as to press against the inclined surface 56, substantially the entire divided punch 5 expands in a radial direction against the elastic force of the O-rings 55. When the mandrel 4 is withdrawn, the divided punch 5 is restored to its original unexpanded state, shown in FIGS. 6A to 6D, by the elastic force of the O-rings 55.

The divided punch 5 according to this embodiment is formed by combining the plurality of separate segments 50*a*, and therefore the entire length region thereof serves as an expandable and contractable portion 50. A tip end portion of the mandrel 4 is preferably formed in a tapered shape such as a truncated conical shape or a conical shape. In this embodiment, the tip end portion of the mandrel 4 is formed in a truncated conical shape and includes a plurality of planar portions 40 that are capable of contacting the inclined surface 56 of the plurality of segments 50*a* by surface contact.

Figure 6A:
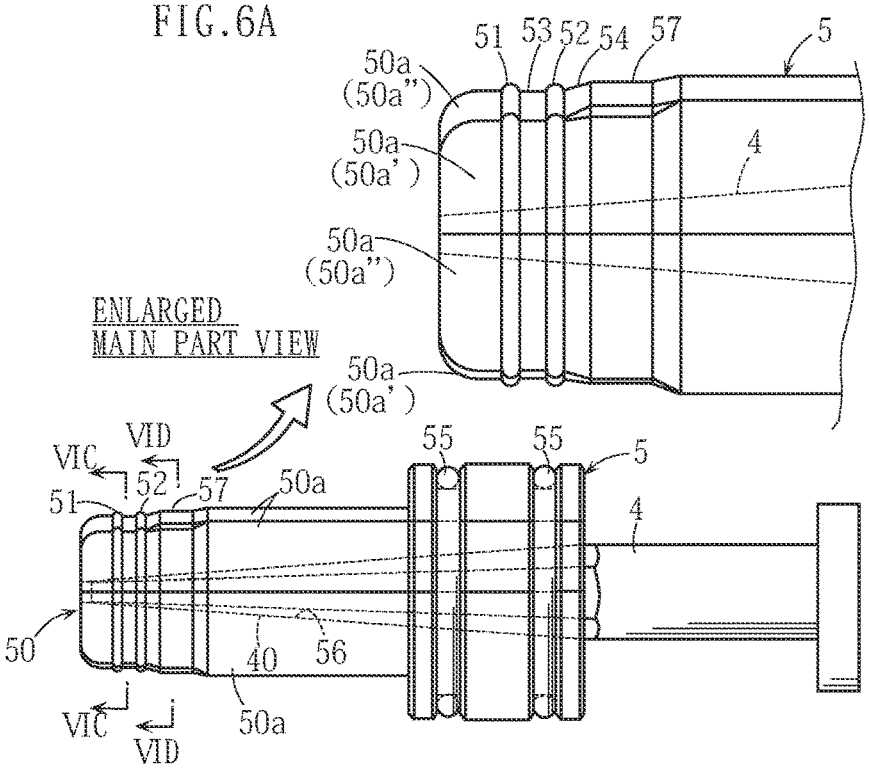
FIG. 6A is a front view showing an example of a divided punch used in a tube expansion operation in an unexpanded state.
Figure 6B:
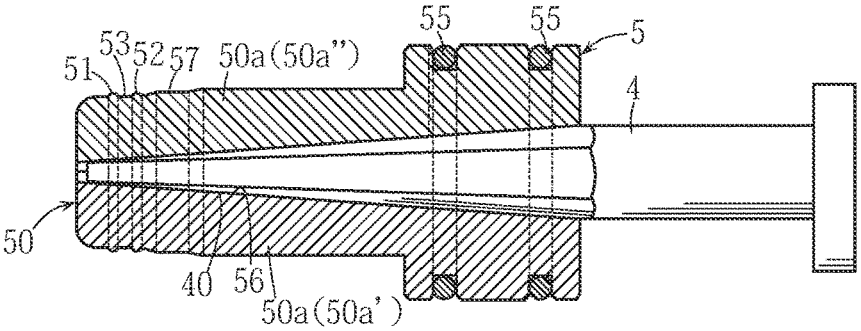
FIG. 6B is a front sectional view thereof.

As is clearly illustrated in the enlarged main part view of FIG. 6A, substantially annular first and second projecting portions 51, 52, a first outer surface portion 53 positioned between the first and second projecting portions 51, 52, an auxiliary portion forming portion 54, and a second outer surface portion 57 are provided on an outer peripheral surface of the divided punch 5 near the tip end portion thereof.

Here, the first and second projecting portions 51, 52 are sites for forming the first and second bulge portions 20*a*, 20*b* of the heat transfer tube 2.

Figure 6C:
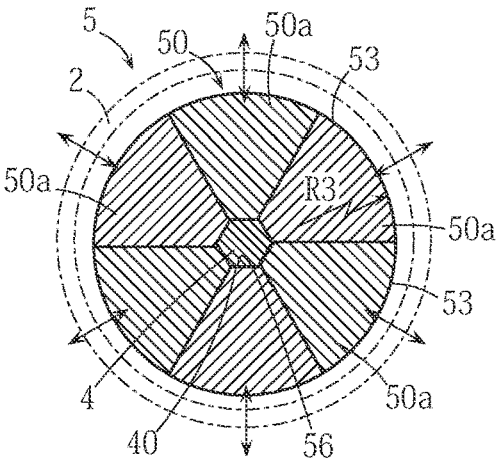
FIG. 6C is a VIC-VIC sectional view of FIG. 6A.
Figure 7A:
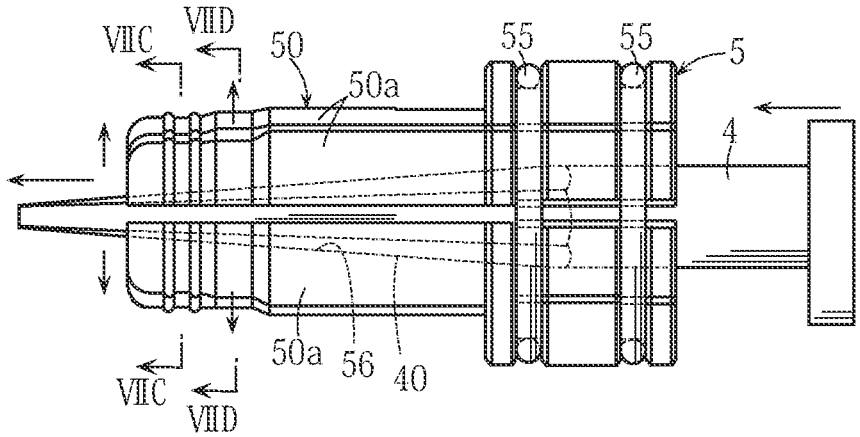
FIG. 7A is a front view showing an example of the divided punch shown in FIG. 6A in an expanded state.
Figure 7B:
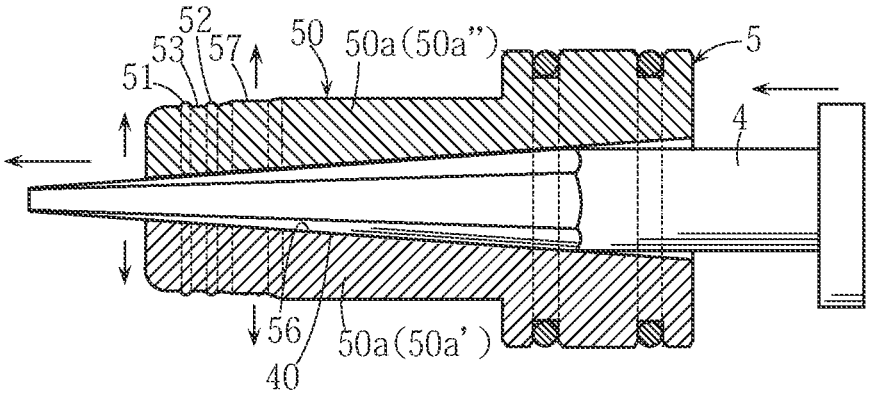
FIG. 7B is a front sectional view thereof.
Figure 7C:
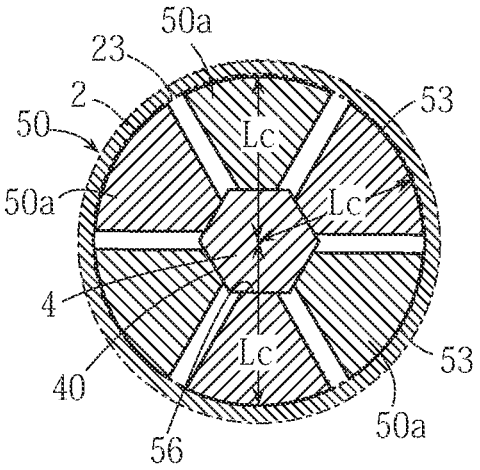
FIG. 7C is a VIIC-VIIC sectional view of FIG. 7A.

The first outer surface portion 53 is a site for forming the press-fitted portion 23 of the heat transfer tube 2. As shown in FIG. 6C, the respective first outer surface portions 53 of the plurality of segments 50*a* all have the same curvature radius R3, and when the heat transfer tube 2 is expanded, as shown in FIG. 7C, the first outer surface portions 53 each have an arc-shaped cross-section on which a distance Lc from a center of the expandable and contractable portion 50 is equal in each location.

Figure 6D:
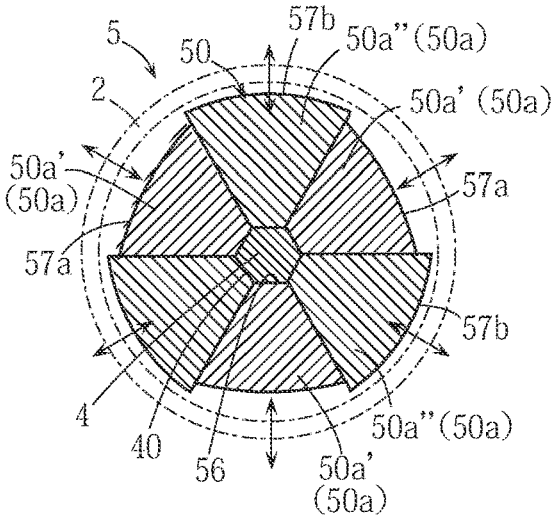
FIG. 6D is a VID-VID sectional view of FIG. 6A.
Figure 7D:
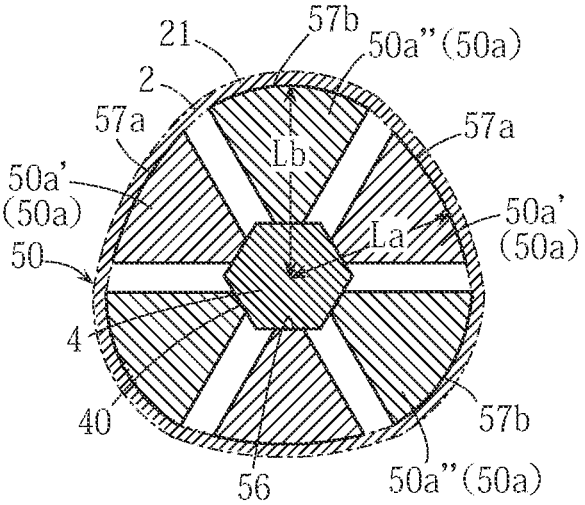
FIG. 7D is a VIID-VIID sectional view of FIG. 7A.

The second outer surface portion 57 is a site for forming the first peripheral wall portion 21 of the heat transfer tube 2. As described above, however, the plurality of first and second curved surface portions 21*a*, 21*b* are provided on the inner peripheral surface of the first peripheral wall portion 21. Therefore, to correspond to this, as shown in FIG. 6D, two types of segments 50*a*', 50*a*" are provided as the plurality of segments 50*a*, and two types of second outer surface portions 57 (57*a*, 57*b*) having different curvature radii are formed thereon. The second outer surface portions 57*a* of the segments 50*a*' are curved surfaces having an arc-shaped cross-section that corresponds to the first curved surface portion 21*a* shown in FIG. 5B, while the second outer surface portions 57*b* of the segments 50*a*" are curved surfaces having an arc-shaped cross-section that corresponds to the second curved surface portion 21*b*. When the heat transfer tube 2 is expanded, as shown in FIG. 7D, distances La, Lb from the center of the expandable and contractable portion 50 to the respective second outer surface portions 57*a*, 57*b* are unequal.

The auxiliary portion forming portion 54 is a site for forming the auxiliary portion 22 of the heat transfer tube 2, described above. The shapes and sizes of the second outer surface portions 57*a*, 57*b* and the auxiliary portion forming portion 54 differ between the two types of segments 50*a*', 50*a*", but the shapes and sizes of the other sites are the same.

Figure 8A:
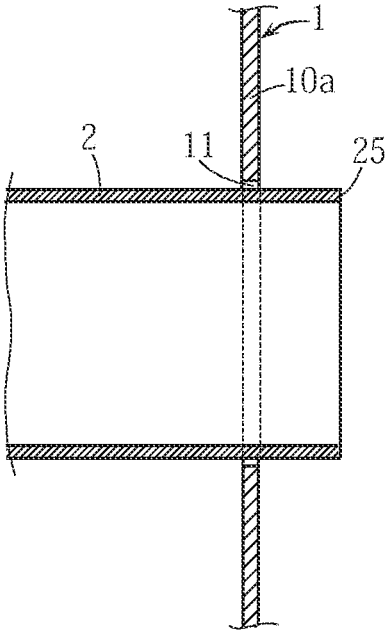
FIGS. 8A to 8C are sectional views showing main parts of an example of a tube expansion operation performed on a heat transfer tube.
Figure 8B:
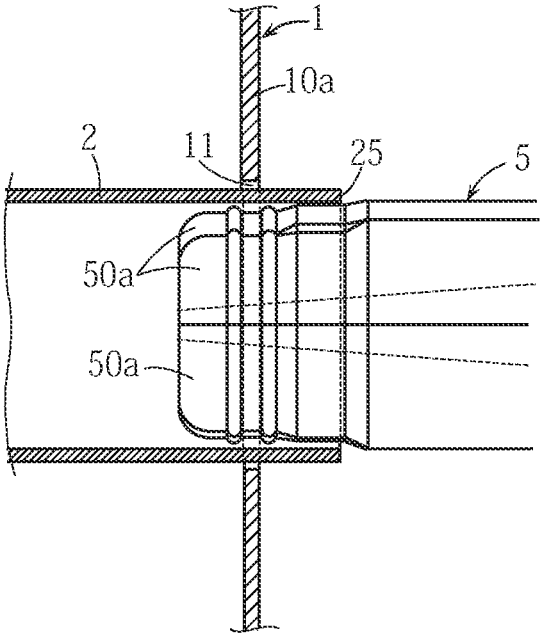
Figure 8C:
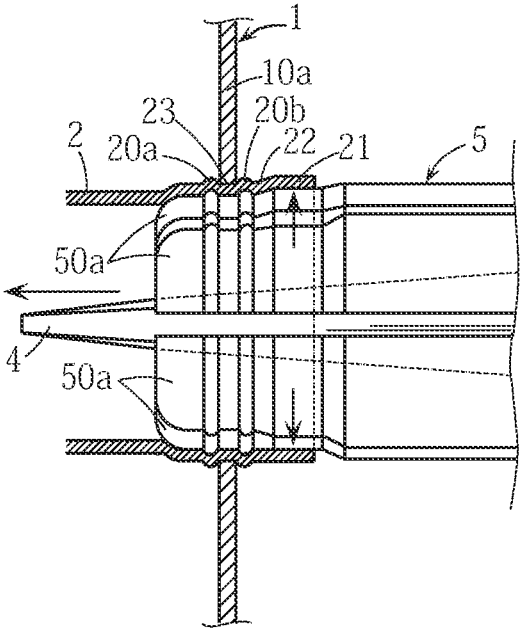

When manufacturing the heat exchanger HE, the divided punch 5 described above is used to implement a tube expansion operation on the heat transfer tube 2 by means of procedures shown in FIGS. 8A to 8C.

First, in a state where the end portion of the heat transfer tube 2 has been inserted through the hole portion 11 in the side wall portion 10*a* of the case 1, as shown in FIG. 8A, the divided punch 5 is inserted into the end portion of the heat transfer tube 2, as shown in FIG. 8B. Next, as shown in FIG. 8C, the divided punch 5 is expanded so as to expand the end portion of the heat transfer tube 2. Thus, the tube expansion portion 20 described with reference to FIGS. 4A, 4B, 5A, and 5B can be provided on the heat transfer tube 2, and the heat transfer tube 2 can also be fixed (provisionally fixed) to the side wall portion 10*a*. Thereafter, the divided punch 5 is returned to its original size and then withdrawn from the heat transfer tube 2, whereupon the end portion 60 of the connecting tube body 6 is fitted into the end portion of the heat transfer tube 2. This operation is performed on each of the plurality of heat transfer tubes 2, but by using a plurality of divided punches 5, the operation can be performed simultaneously on the plurality of heat transfer tubes 2. When the process described above is complete, a brazing operation is performed to provide the brazed portions Ba, Bb described above.

With the heat exchanger HE according to this embodiment, the following actions are obtained.

As shown in FIG. 5B, the first peripheral wall portion 21 of the heat transfer tube 2 and the second peripheral wall portion 62 of the connecting tube body 6 have different sectional shapes, and the plurality of first curved surface portions 21*a* of the first peripheral wall portion 21 are fitted to the outer peripheral surface of the second peripheral wall portion 62 in a state of partial contact therewith (the first and second peripheral wall portions 21, 62 are fitted together in a fitting state including the plurality of contact portions Pa and non-contact portions Pb). Therefore, even if interference constituting the fitting tolerance between the first and second peripheral wall portions 21, 62 is comparatively large, the first and second peripheral wall portions 21, 62 can be fitted together smoothly and easily. As a result, the ease of an assembly operation can be improved.

Further, since the first and second peripheral wall portions 21, 62 are in partial contact with each other, an appropriate degree of frictional force is generated therebetween. Moreover, as shown in FIG. 5B, the plurality of contact portions Pa form three point-contact portions positioned at equal intervals. Therefore, when the connecting tube body 6 is fitted to the heat transfer tube 2, the connecting tube body 6 can be provisionally held with stability. As a result, the danger of the connecting tube body 6 inadvertently falling off the heat transfer tube 2 before the operation for brazing the connecting tube body 6 to the heat transfer tube 2 is performed can be eliminated.

In this embodiment, when the tube expansion portion 20 is formed by implementing tube expansion processing on the heat transfer tube 2, the first peripheral wall portion 21 may be set so that a certain degree of interference occurs in relation to the second peripheral wall portion 62 of the connecting tube body 6. When, in contrast to this embodiment, the first and second peripheral wall portions 21, 62 have identical hollow, circular cross-sections and the interference is large, it becomes difficult to fit the first and second peripheral wall portions 21, 62 together, and to avoid this, it is necessary to perform precision finishing so that the fitting tolerance therebetween is within a narrow predetermined dimension range. According to this embodiment, however, this need can be eliminated or mitigated, and therefore the sizes of the first and second peripheral wall portions 21, 62 may be finished comparatively roughly so that a certain degree of interference occurs as the fitting tolerance therebetween. As a result, the manufacturing operation can be further facilitated, enabling an improvement in productivity. When the heat transfer tube 2 and the connecting tube body 6 are made of stainless steel, with which it is more difficult to improve the dimension precision of the respective parts than with copper or the like, for example, the above effects of this embodiment are even more welcome.

The press-fitted portion 23 of the tube expansion portion 20 is press-fitted to the inner peripheral surface of the hole portion 11 provided in the side wall portion 10*a* of the case 1, and the first and second bulge portions 20*a*, 20*b* sandwich the respective sides of the side wall portion 10*a*. Hence, the heat transfer tube 2 can be fixed (provisionally fixed) to the side wall portion 10*a* appropriately, favorable fitting precision can be achieved between the hole portion 11 and the heat transfer tube 2, and the brazed portion Ba can be provided appropriately.

Furthermore, the part including the end portion tip end 25 of the heat transfer tube 2 and the vicinity thereof is the site that is subjected to tube expansion processing in order to form the first peripheral wall portion 21, described above, and therefore the dimension precision of this part can also be improved. More specifically, when the first and second bulge portions 20*a*, 20*b* are formed near the end portion tip end 25 of the heat transfer tube 2, there is a danger that the aperture of the part including the end portion tip end 25 and the vicinity thereof will shrink in reaction thereto, but according to this embodiment, this danger can be appropriately eliminated.

Meanwhile, according to the manufacturing method for the heat exchanger HE described above, the respective locations of the tube expansion portion 20 can be provided appropriately by a single tube expansion operation using the divided punch 5. As a result, the productivity of the heat exchanger HE can be improved.

FIGS. 9A and 9B to 12A and 12B show other embodiments of the present invention. In these figures, identical or similar elements to those of the embodiment described above have been allocated identical reference symbols to the above embodiment, and duplicate description thereof has been omitted.

Figure 9A:
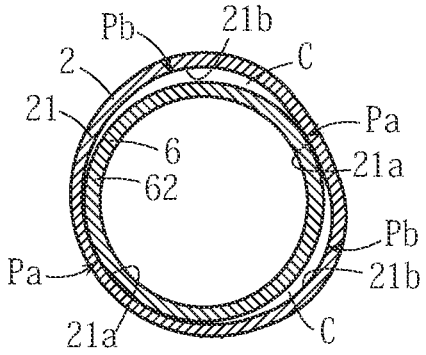
FIG. 9A is a sectional view showing another example of the present invention.

In an embodiment shown in FIG. 9A, two second curved surface portions 21*b* are provided on the inner peripheral surface of the first peripheral wall portion 21 of the heat transfer tube 2 such that the gap C is formed in two locations, and the remaining parts of the inner peripheral surface form the first curved surface portions 21*a*. In this embodiment, two contact portions Pa and two non-contact portions Pb are provided.

Figure 9B:
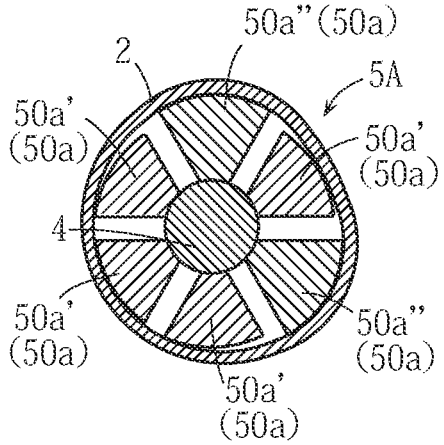
FIG. 9B is a sectional view showing a state in which a heat transfer tube shown in FIG. 9A is formed.

As shown in FIG. 9B, this configuration can be formed by dividing the six segments 50*a* of a divided punch 5A into two segments 50*a*" having an outer surface portion that corresponds to the second curved surface portion 21*b* and four segments 50*a*' having an outer surface portion that corresponds to the first curved surface portion 21*a*. Note that a mandrel having a circular cross-section is used as the mandrel 4 (likewise in the other embodiments shown in FIGS. 10A, 10B, 11A, and 11B).

In this embodiment, two contact portions Pa and two non-contact portions Pb are provided, and the two contact portions Pa are arranged opposite each other with the center of the first and second peripheral wall portions 21, 62 therebetween, which is favorable for stabilizing the fitting state between the first and second peripheral wall portions 21, 62.

Figure 10A:
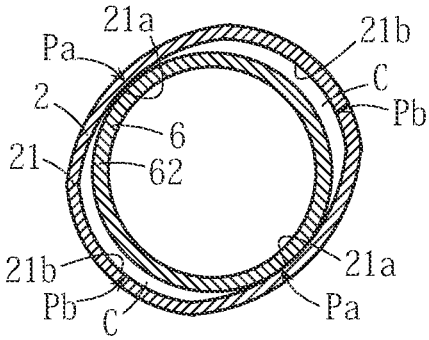
FIG. 10A is a sectional view showing another example of the present invention.

Likewise in an embodiment shown in FIG. 10A, similarly to FIG. 9A, two second curved surface portions 21*b* are provided on the inner peripheral surface of the first peripheral wall portion 21 of the heat transfer tube 2 such that the gap C is formed in two locations, while the remaining sites of the inner peripheral surface form the first curved surface portions 21*a*. In other words, two contact portions Pa and two non-contact portions Pb are provided.

Figure 10B:
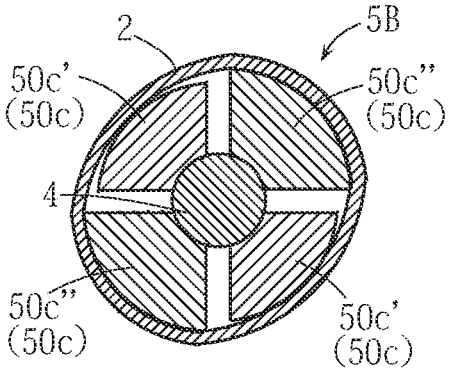
FIG. 10B is a sectional view showing a state in which a heat transfer tube shown in FIG. 10A is formed.

Note, however, that a divided punch having a plurality of segments 50*c* divided into four parts, as shown in FIG. 10B, is used as a divided punch 5B for acquiring this configuration. Of the plurality of segments 50*c*, two segments 50*c*' have an outer surface portion that corresponds to the first curved surface portion 21*a*, and two segments 50*c*" have an outer surface portion that corresponds to the second curved surface portion 21*b*.

Likewise in this embodiment, similarly to the embodiment of FIG. 9A, the two contact portions Pa are arranged opposite each other with the central portions of the first and second peripheral wall portions 21, 62 therebetween, and as a result, the fitting state between the first and second peripheral wall portions 21, 62 can be stabilized.

Figure 11A:
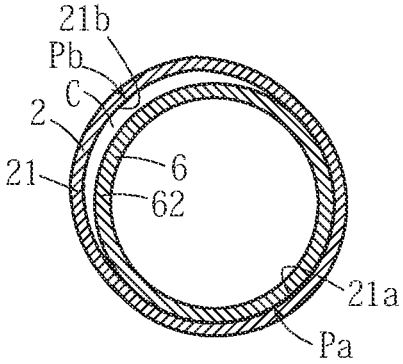
FIG. 11A is a sectional view showing another example of the present invention.

In an embodiment shown in FIG. 11A, only one second curved surface portion 21*b* is provided on the inner peripheral surface of the first peripheral wall portion 21 of the heat transfer tube 2, and the remaining part of the inner peripheral surface forms the first curved surface portion 21*a*. The location on the first and second peripheral wall portions 21, 62 in which the second curved surface portion 21*b* is provided serves as the non-contact portion Pb, and the other location serves as the contact portion Pa.

Figure 11B:
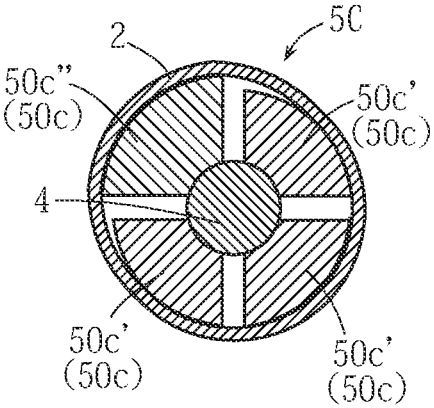
FIG. 11B is a sectional view showing a state in which a heat transfer tube shown in FIG. 11A is formed.

As shown in FIG. 11B, this configuration can be obtained by using the four segments 50*c* as a divided punch 5C, forming one segment 50*c*", among the four segments 50*c*, to have an outer surface portion that corresponds to the second curved surface portion 21*b*, and forming the remaining segments 50*c*' to have an outer surface portion that corresponds to the first curved surface portion 21*a*.

According to this embodiment, although the first and second peripheral wall portions 21, 62 have only one contact portion Pa, in the contact portion Pa, the first curved surface portion 21*a* is in surface contact with the outer peripheral surface of the second peripheral wall portion 62 over a range of at least half of the entire circumference thereof. As a result, the fitting state between the first and second peripheral wall portions 21, 62 can be stabilized.

Figure 12A:
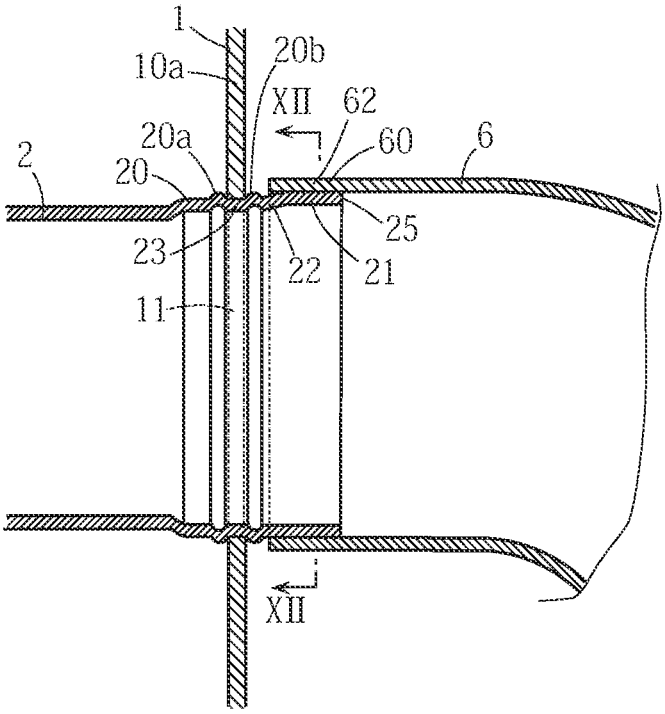
FIG. 12A is a sectional view showing main parts of another example of the present invention.
Figure 12B:
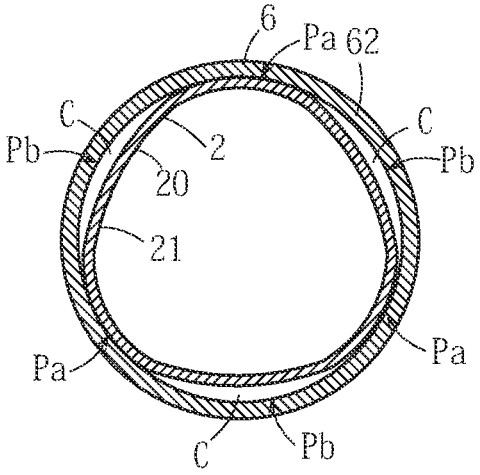
FIG. 12B is an XII-XII sectional of FIG. 12A.

In an embodiment shown in FIGS. 12A and 12B, the end portion 60 of the connecting tube body 6 is externally fitted to the tube expansion portion 20 of the heat transfer tube 2. According to this embodiment, although a disadvantage occurs in that the end portion 60 of the connecting tube body 6 cannot be inserted into the case 1 beyond the side wall portion 10*a* of the case 1, it is possible to employ such a configuration. In the case of this embodiment, as shown in FIG. 12B, the contact portions Pa are constituted by sites in which parts of the outer peripheral surface of the first peripheral wall portion 21 of the heat transfer tube 2 partially contact the inner peripheral surface of the second peripheral wall portion 62 of the connecting tube body 6.

The present invention is not limited to the content of the embodiments described above, and the specific configurations of the respective parts of the heat exchanger according to the present invention may be freely subjected to various design modifications within the intended scope of the present invention. The specific configurations of the respective processes of the manufacturing method for a heat exchanger according to the present invention may be modified freely within the intended scope of the present invention.

In the embodiments described above, the tube expansion operation is performed using a divided punch having six or four segments, but the number of segments is not limited thereto. Further, the sizes of the plurality of segments may be uniformly aligned so that the plurality of segments are arranged at equal angular intervals, or instead, the plurality of segments may be configured to have non-uniform sizes.

In the present invention, a flared portion having a flared shape may additionally be formed in a position at the furthest tip end (a position even further toward the end portion tip end side than the first peripheral wall portion) of the tube expansion portion of the heat transfer tube.

The heat transfer tube is not limited to an entirely straight tube shape and may have a meandering shape, a spiral shape, or the like. The trunk pipe 39 of the embodiment described above may also be included in the heat transfer tube according to the present invention. Not all of the plurality of heat transfer tubes provided in the heat exchanger need have the intended configuration of the present invention, and as long as some of the heat transfer tubes have an attachment structure configured as intended by the present invention, the resulting configurations belong to the technical scope of the present invention.

The heat exchanger according to the present invention is not limited to a reverse combustion system in which combustion gas advances downward, and may be applied to a normal combustion system in which combustion gas advances upward. Moreover, the heat exchanger according to the present invention may be configured so as not to include the trunk pipes. Furthermore, the heat exchanger is not limited to use in a water heater. The heating medium is not limited to combustion gas, and high-temperature exhaust gas generated from a power generation system, for example, may be used instead.

The invention claimed is:

1. A heat exchanger comprising:

a case having a side wall portion, a heating medium being supplied into an interior of the case;

a plurality of heat transfer tubes that are drawn out to an outside from the interior of the case by inserting end portions thereof respectively through a plurality of hole portions provided in the side wall portion;

at least one connecting tube body for connecting the plurality of heat transfer tubes to each other;

a tube expansion portion provided on each of the heat transfer tubes so as to form a press-fitted portion in which an outer peripheral surface of each heat transfer tube is press-fitted to an inner peripheral surface of each of the hole portions;

a first peripheral wall portion provided on the tube expansion portion in a position further toward an end portion tip end side of each of the heat transfer tubes than the press-fitted portion; and a second peripheral wall portion positioned on an end portion of the connecting tube body and fitted to the tube expansion portion, wherein the first and second peripheral wall portions have different sectional shapes and are fitted together in a partial contact state including a plurality of contact portions in which respective circumferential direction parts of the first and second peripheral wall portions contact each other and a non-contact portion in which other parts are separated from each other via a gap, the first peripheral wall portion has a hollow, non-circular cross-sectional shape, and the end portion of the connecting tube body has a hollow, circular cross-sectional shape, an inner peripheral surface of the first peripheral wall portion includes a plurality of first curved surface portions and a plurality of second curved surface portions alternately connected in a circumferential direction, the first and second curved surface portions being the only curved surface portions of the inner peripheral surface of the first peripheral wall portion, each of the first and second curved surface portions having an outwardly convex circular arc shape, each of the plurality of first curved surface portions has a curvature radius larger than a curvature radius of an outer peripheral surface of the second peripheral wall portion of the connecting tube body, and a part thereof contacts the outer peripheral surface of the second peripheral wall portion at one of the plurality of contact portions, each of the plurality of second curved surface portions connects two of the plurality of first curved surface portions to each other without contacting the outer peripheral surface of the second peripheral wall portion, and a curvature radius of each of the plurality of second curved surface portions is smaller than the curvature radius of the outer peripheral surface of the second peripheral wall portion.

2. The heat exchanger according to claim 1, wherein the plurality of contact portions are positioned at equal intervals in the circumferential direction of the first and second peripheral wall portions, and a plurality of non-contact portions are respectively positioned between the plurality of contact portions in the circumferential direction of the first and second peripheral wall portions as the non-contact portion.

3. The heat exchanger according to claim 1, wherein the heat transfer tubes and the connecting tube bodies are both formed using round pipes, and the hole portions in the side wall portion are circular, and the press-fitted portion and the second peripheral wall portion have a hollow, circular sectional shape.

4. The heat exchanger according to claim 3, wherein the tube expansion portion extends inside the case beyond the press-fitted portion, and the second peripheral wall portion is fitted into the tube expansion portion so as to advance to a position further inside the case than the press-fitted portion.

5. The heat exchanger according to claim 1, wherein the tube expansion portion includes first and second bulge portions in which the outer peripheral surface of each heat transfer tube partially bulges outward in a radial direction so as to sandwich the side wall portion in an axial length direction of the heat transfer tube, and which are connected to respective sides of the press-fitted portion, and the first peripheral wall portion is positioned further toward the end portion tip end side of the heat transfer tube than the press-fitted portion and the second bulge portion of the tube expansion portion.

6. The heat exchanger according to claim 5, wherein the second bulge portion has a hollow, circular sectional shape, and the tube expansion portion includes an auxiliary portion that is positioned between the second bulge portion and the first peripheral wall portion in order to create variation in the sectional shape from the second bulge portion to the first peripheral wall portion.

* * * * *